US006166753A

United States Patent [19]

Hara

[11] Patent Number: 6,166,753

[45] Date of Patent: Dec. 26, 2000

[54] THERMAL PRINTER

[75] Inventor: Kei Hara, Shizuoka-ken, Japan

[73] Assignee: Toshiba Tec Kabushiki Kaisha, Tokyo, Japan

[21] Appl. No.: 09/238,278

[22] Filed: Jan. 27, 1999

[30] Foreign Application Priority Data

Jan. 30, 1998 [JP] Japan ..... 10-019917
Mar. 31, 1998 [JP] Japan ..... 10-086727

[51] Int. Cl.[7] ..... B41J 2/375

[52] U.S. Cl. ..... 347/193

[58] Field of Search ..... 347/172, 174, 347/175, 191, 192, 193, 215, 218, 221

[56] References Cited

U.S. PATENT DOCUMENTS 5,247,313 9/1993 Oosaka et al. ..... 347/172
5,537,140 7/1996 Hayashi et al. ..... 347/175

FOREIGN PATENT DOCUMENTS 5-293993 11/1993 Japan .

*Primary Examiner*—N. Le
*Assistant Examiner*—Anh T. N Vo
*Attorney, Agent, or Firm*—Frishauf, Holtz, Goodman, Langer & Chick, P.C.

[57] ABSTRACT

A thermal printer applies heat to print a multicolor image on a heat-sensitive paper having a stack of color development layers which have different development characteristics. The printer includes a paper feed motor for feeding the heat-sensitive paper, and a thermal line head for heating the heat-sensitive paper fed by the paper feed motor. Particularly, the printer further includes a CPU for performing a print control process of driving the thermal line head such that each part of the heat-sensitive paper develops a specific color depending on the number of times thermal energy has been applied to the part. The thermal energy is not higher than the lowest of different thermal energies which are required for developing the color development layers.

7 Claims, 9 Drawing Sheets

FIRST HEATING PATTERN

SECOND HEATING PATTERN

PRINT PATTERN

FIRST HEATING PATTERN

SECOND HEATING PATTERN

THIRD HEATING PATTERN

PRINT PATTERN

THERMAL PRINTER

BACKGROUND OF THE INVENTION

The present invention relates to a thermal printer for performing multicolor printing and, more particularly, to a thermal printer in which printing is performed using multicolor heat-sensitive paper obtained by coating base paper with a plurality of color development layers.

This thermal printer has a thermal line head constituted by heating elements arrayed in a direction perpendicular to the feed direction of, e.g., multicolor heat-sensitive paper. The thermal printer drives these heating elements to print dots for one line.

Dual-color heat-sensitive paper, for example, of a discoloration type and an additive color type are conventionally known as the multicolor heat-sensitive paper. The discoloration type heat-sensitive paper has a structure in which three layers, i.e., a red color development layer, discoloration layer, and black color development layer are stacked on base paper. The additive color type heat-sensitive paper has a structure in which black and red color development layers are stacked on base paper. Each of these discoloration and additive color type heat-sensitive paper is coated with a coating layer to prevent a yellowish surface due to long-term storage or the like. The heating elements of the thermal head heat such heat-sensitive paper to form red or black dots constituting an image such as a character or graphic pattern. The red dot is obtained by heating the heat-sensitive paper with a red developing thermal energy for melting a red color development layer, while the black dot is obtained by heating the heat-sensitive paper with a black developing thermal energy for melting the black color development layer.

In the above thermal printer, an image including, e.g., red and black characters can be printed in a batch printing scheme of forming both the red and black characters or in a division printing scheme of forming one of the red and black characters first and then forming the other.

In either printing scheme, the thermal printer drives heating elements corresponding to each red character with a heat current corresponding to the red developing thermal energy. Similarly, the thermal printer drives heating elements corresponding to each black character with a heat current corresponding to the black developing thermal energy. The thermal energy applied to the heat-sensitive paper depends on a product of the heat current and the heat period. When the feed speed of the heat-sensitive paper is made constant to determine the heat period, the thermal line head is heated up to a higher temperature during the printing of black characters than that obtained during the printing of red characters. This results in that the quality of printing is degraded due to deterioration of the head while the service life of the head is undesirably shortened.

BRIEF SUMMARY OF THE INVENTION

It is an object of the present invention to provide a thermal printer capable of improving the durability of a head.

There is provided a thermal printer for applying heat to print a multicolor image on a heat-sensitive paper having a stack of color development layers which have different development characteristics, the thermal printer comprising a paper feed mechanism for feeding the heat-sensitive paper; a thermal head for heating the heat-sensitive paper fed by the paper feed mechanism; and a control unit for performing a print control process of driving the thermal head such that each part of the heat-sensitive paper develops a specific color depending on the number of times thermal energy has been applied to the part, the thermal energy being not higher than the lowest of different thermal energies which are required for developing the color development layers.

In this thermal printer, a thermal energy exceeding the lowest thermal energy is not applied from the thermal head in color development of any one of the color development layers. Therefore, the durability of the head can be improved.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

A thermal printer according to the first embodiment of the present invention will be described with reference to the accompanying drawings.

Figure 1:
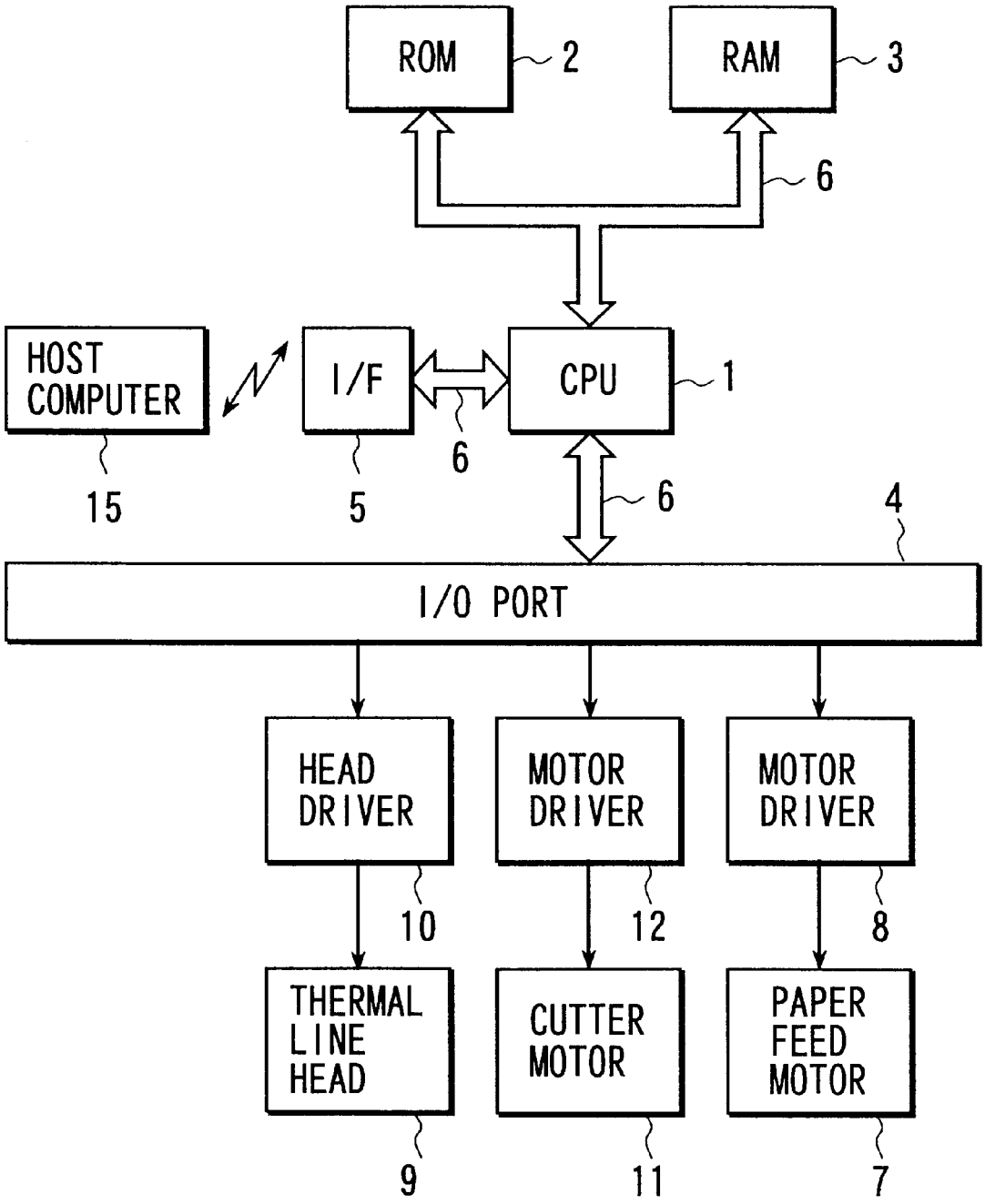
FIG. 1 is a schematic block diagram showing the circuit arrangement of a thermal printer according to a first embodiment of the present invention.

FIG. 1 schematically shows the circuit arrangement of this thermal printer. The thermal printer comprises a CPU (Central Processing Unit) 1 serving as a main controller, a ROM (Read-Only Memory) storing program data or the like for allowing the CPU 1 to control various components, a RAM (Random Access Memory) 3 including memory areas used for data processing, an I/O (Input/Output) port 4, and an I/F (interface) 5. The CPU 1 is electrically connected to the ROM 2, RAM 3, I/O port 4, and I/F 5 via bus lines 6 such as an address bus, data bus, and control bus.

The I/O port 4 is connected to a motor driver 8 for driving a paper feed motor 7 capable of feeding continuous heat-sensitive paper in the forward or backward direction, a head driver 10 for ON/OFF-driving a line of heating elements on a thermal line head 9 to heat the heat-sensitive paper, a motor driver 12 for driving a cutter motor 11 for driving a cutter 21, and a control panel (not shown) for controlling other various operations, for example.

Figure 3A:
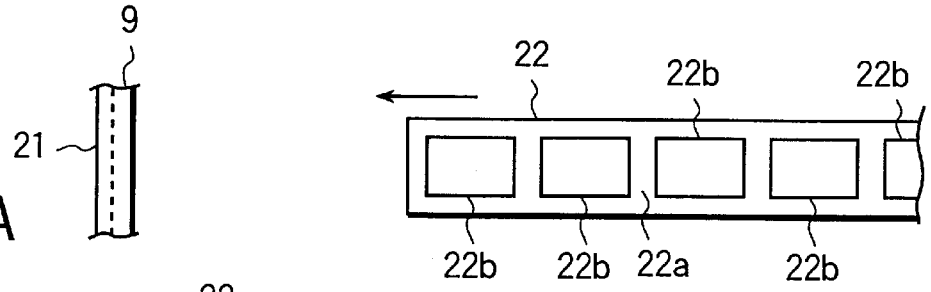
FIGS. 3A to 3F are views for explaining the operation of the thermal printer shown in FIG. 1.
Figure 3B:
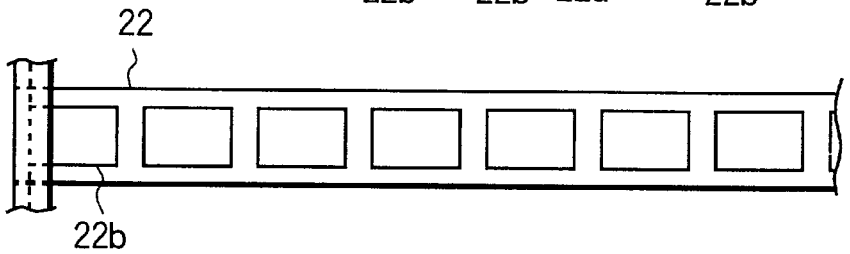
Figure 3C:
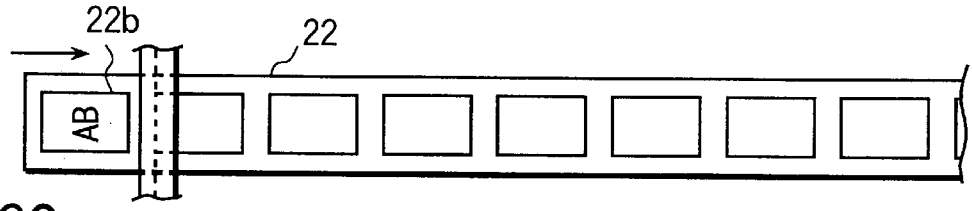

The cutter 21 is disposed near the thermal line head 9, as shown in FIGS. 3A to 3C, to cut the heat-sensitive paper printed by the thermal line head 9. The I/F 5 is connected via a communication line to a host device 15 such as a personal computer or the like.

Figure 12:
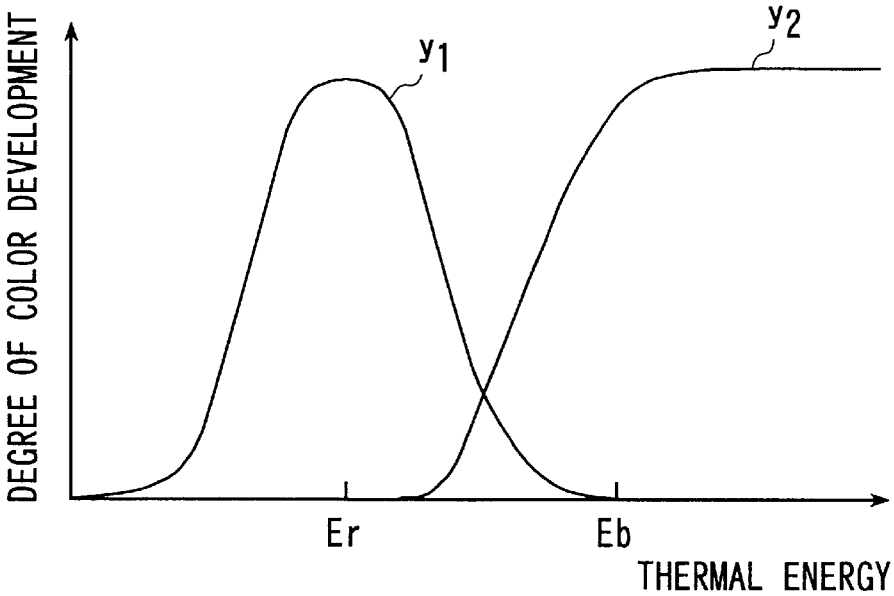
FIG. 12 is a graph showing the characteristics of heat-sensitive paper shown in FIG. 11.

This thermal printer uses heat-sensitive paper 22 including continuous base paper 22*a* and heat-sensitive portions 22*b* arranged in series on the base paper 22*a* and spaced from each other by a constant distance as shown in FIGS. 3A to 3C and 11. Each heat-sensitive portion 22*b* is obtained by stacking a color development layer 102 to be developed in black, a color development layer 103 to be developed in red, and a coating layer 104 on the base paper 22*a*. The color development layer 102 has development characteristics represented by a characteristic curve y2 shown in FIG. 12, and the color development layer 103 has development characteristics represented by a characteristic curve y1 shown in FIG. 12, and the coating layer is used for preventing a yellowish surface due to long-term storage, for example.

With the heat-sensitive paper 22, the color development layer 103 is developed by a thermal energy Er, and the color development layer 102 is developed by a thermal energy Eb which is about twice the thermal energy Er. The color development layer 102 can be developed without being applied with the thermal energy Eb once, if the thermal energy Er is applied twice to total up to the thermal energy Eb.

Figure 2:
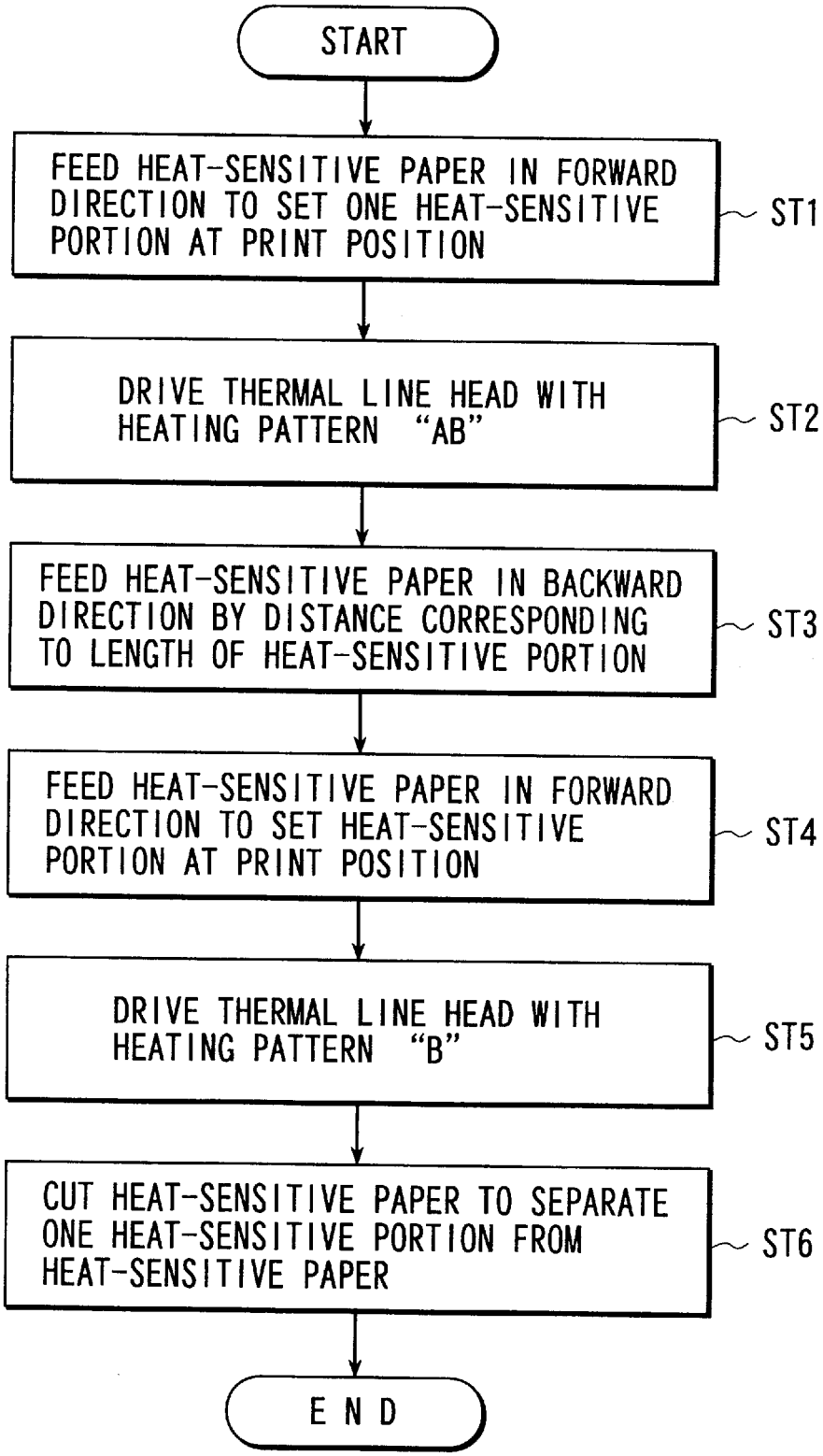
FIG. 2 is a flowchart showing a print control process of a CPU shown in FIG. 1.

In the case where the above thermal printer prints a red character "A" and a black character "B" on the heat-sensitive paper 22, the CPU 1 thereof performs a print control process shown in FIG. 2 on the basis of the above principle. More specifically, in step ST1, the CPU 1 drives the paper feed motor 7 in the forward direction to advance the heat-sensitive paper 22 so that the heat-sensitive portion 22*b* is brought into a printing position corresponding to the thermal line head 9. This changes the state of the heat-sensitive paper 22 from the state shown in FIG. 3A to the state shown in FIG. 3B. In this case, for example, a paper sensor may detect the leading end of the heat-sensitive paper 22, and the paper may be fed from the detection position by a predetermined amount.

Figure 3D:
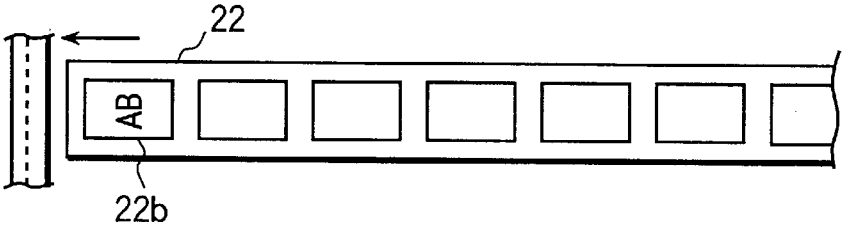
Figure 4A:
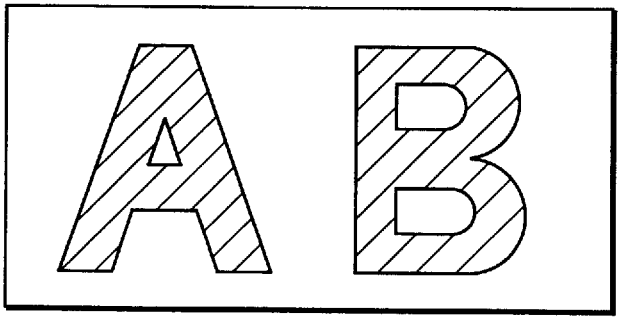
FIGS. 4A to 4C are views showing first and second heating patterns of the thermal head and a print pattern on heat-sensitive paper.

In step ST2, the thermal line head 9 is driven with a heating pattern "AB" shown in FIG. 4A to heat one heat-sensitive portion 22*b* with the thermal energy Er. At this time, a print pattern "AB" shown in FIG. 3C is printed in red. In step ST3, the paper feed motor 7 is driven in the reverse direction to return the head-sensitive paper 22 by a distance corresponding to the length of the printed heat-sensitive portion 22*b*. This changes the state of the heat-sensitive paper 22 from the state shown in FIG. 3C to the state shown in FIG. 3D.

In step ST4, the paper feed motor 7 is driven in the forward direction again to advance the heat-sensitive paper 22 so that the heat-sensitive portion 22*b* is brought into the printing position corresponding to the thermal line head 9. This changes the state of the heat-sensitive paper 22 from the state in FIG. 3D to the state in FIG. 3E.

Figure 3E:
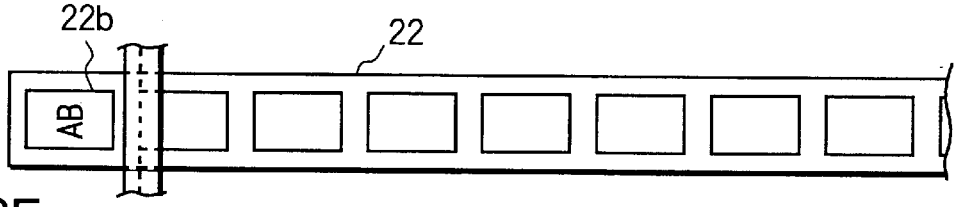
Figure 3F:
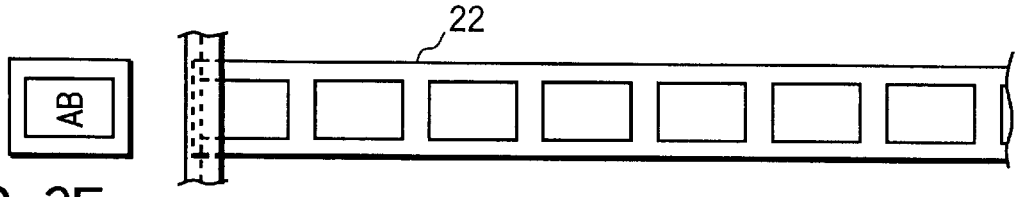
Figure 4B:
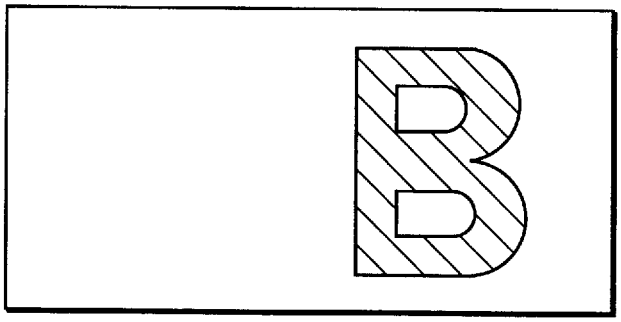
Figure 4C:
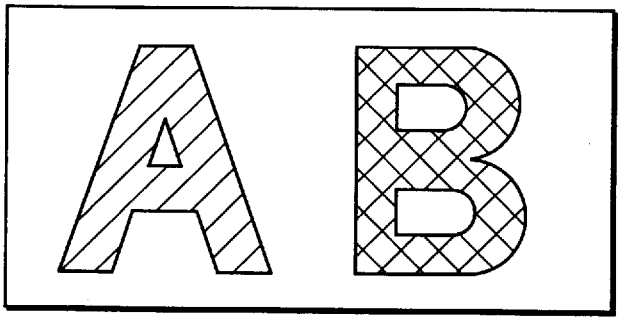

In step ST5, the thermal line head 9 is driven with a heating pattern "B" shown in FIG. 4B to heat the heat-sensitive portion 22*b* with the same thermal energy as that in step ST2 again. The total amount of thermal energy which is applied to the heat-sensitive portion 22*b* according to the heating pattern "B" reaches the thermal energy level Eb, which is twice the thermal energy Er. As a result, the print pattern "B" is printed in black. That is, the print pattern "A" remains red as shown in FIG. 3E or 4C, while the print pattern "B" turns black. Thereafter, the cutter motor 11 is then driven to cut the printed heat-sensitive portion 22*b* from the heat-sensitive paper 22 as shown in FIG. 3F.

In this embodiment, the first print process is performed by driving the thermal line head 9 with the heating pattern "AB" to heat the heat-sensitive paper 22 with the thermal energy Er. The second print process is performed by driving the thermal line head 9 with the heating pattern "B" to heat the heat-sensitive paper 22 with the same thermal energy Er as that of the first print process again. The heat-sensitive paper 22 is developed in red within a region heated only in the first print process and in black within a region heated in the first and second print processes.

As described above, the thermal line head 9 can always print a multicolor image without applying a thermal energy exceeding the red developing thermal energy Er. The heat-sensitive paper 22 need not be heated with the thermal energy Eb applied once, and therefore the durability of the thermal line head 9 can be improved. This also prevents print quality from being degraded due to deterioration of the head.

Since the heat-sensitive paper 22 need not be heated with the thermal energy Eb applied once, the heat-sensitive paper can be fed at a constant speed not considerably slow, thereby shortening the overall printing time.

Since the thermal energy applied in the first print process is equal to that in the second print process, adjustment of the thermal energy is not required for each printing. Therefore, control for developing two colors can be simplified.

In this embodiment, printing is performed on the heat-sensitive paper 22 obtained by stacking the color development layer 103 to be developed in red by the thermal energy Er and the color development layer 102 to be developed in black by the thermal energy Eb. The present invention, however, is not limited to this, but is applicable to printing on a heat-sensitive paper 22 having a stack of three or more color development layers to be developed by different thermal energies. Preferably, the heat-sensitive paper 22 has a structure that the different thermal energies are selected to be integer multiples of the lowest thermal energy required for developing one of the color development layers. With this heat-sensitive paper 22, a print process can be repeated with the lowest thermal energy. Further, since an N number of color development layers can be developed during an N number of print processes, the total printing time can be shortened. In this embodiment, the total printing time can be further shortened since the heat-sensitive paper is returned on the basis of the length of the heat-sensitive portion 22*b* before the second print process.

A thermal printer according to the second embodiment of the present invention will be described with reference to the accompanying drawings. This thermal printer is identical to that of FIG. 1 except for the structure described below. Therefore, similar components are denoted by the same reference numerals, and detailed description thereof will be omitted.

Further, this embodiment is described about the case where the characters "A" and "B" of different colors are printed. However, the present invention is not limited to the first embodiment, and also applicable to the case where concentric circles of different colors are printed, for example.

In the first embodiment, printing is performed on the heat-sensitive paper 22 obtained by stacking the color development layer to be developed by the lowest thermal energy and the color development layer to be developed by the thermal energy which is an integer multiple of the lowest thermal energy. However, in the second embodiment, printing shown in FIGS. 6A to 6H is performed on heat-sensitive paper 32 having a stack of color development layers to be developed by thermal energies which have substantially an integer ratio.

Figure 8:
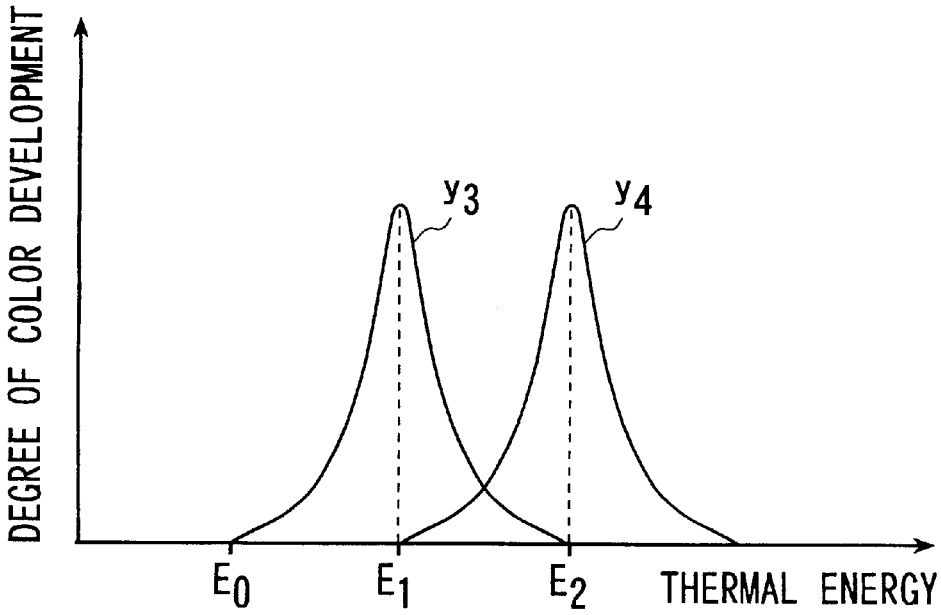
FIG. 8 is a graph showing the characteristics of heat-sensitive paper used in the thermal printer arranged as in FIG. 5.

The heat-sensitive paper 32 includes continuous base paper 32*a* and heat-sensitive portions 32*b* arranged in series on the base paper 32*a* and spaced from each other by a constant distance as shown in FIGS. 6A to 6H and 12. Each heat-sensitive portion 32*b* is obtained by stacking a color development layer 102 to be developed in black, a color development layer 103 to be developed in red, and a coating layer 104 on the base paper 32*a*. The color development layer 102 has development characteristics represented by a characteristic curve y4 shown in FIG. 8, and the color development layer 103 has development characteristics represented by a characteristic curve y3 shown in FIG. 8, and the coating layer is used for preventing a yellowish surface due to long-term storage, for example.

With the heat-sensitive paper 32, the color development layer 103 is developed by a thermal energy E1 which is twice a reference thermal energy E0, and the color development layer 102 is developed by thermal energy E2 which is triple the reference thermal energy E0. That is, the ratio of the thermal energies E1 and E2 is 2:3, and the reference thermal energy E0 is defined as a common measure of the above ratio. The color development layer 103 can be developed if the reference thermal energy E0 is applied twice to total up to the thermal energy E1, and the color development layer 102 can be developed if the reference thermal energy E0 is applied three times to total up to the thermal energy E2.

Figure 5:
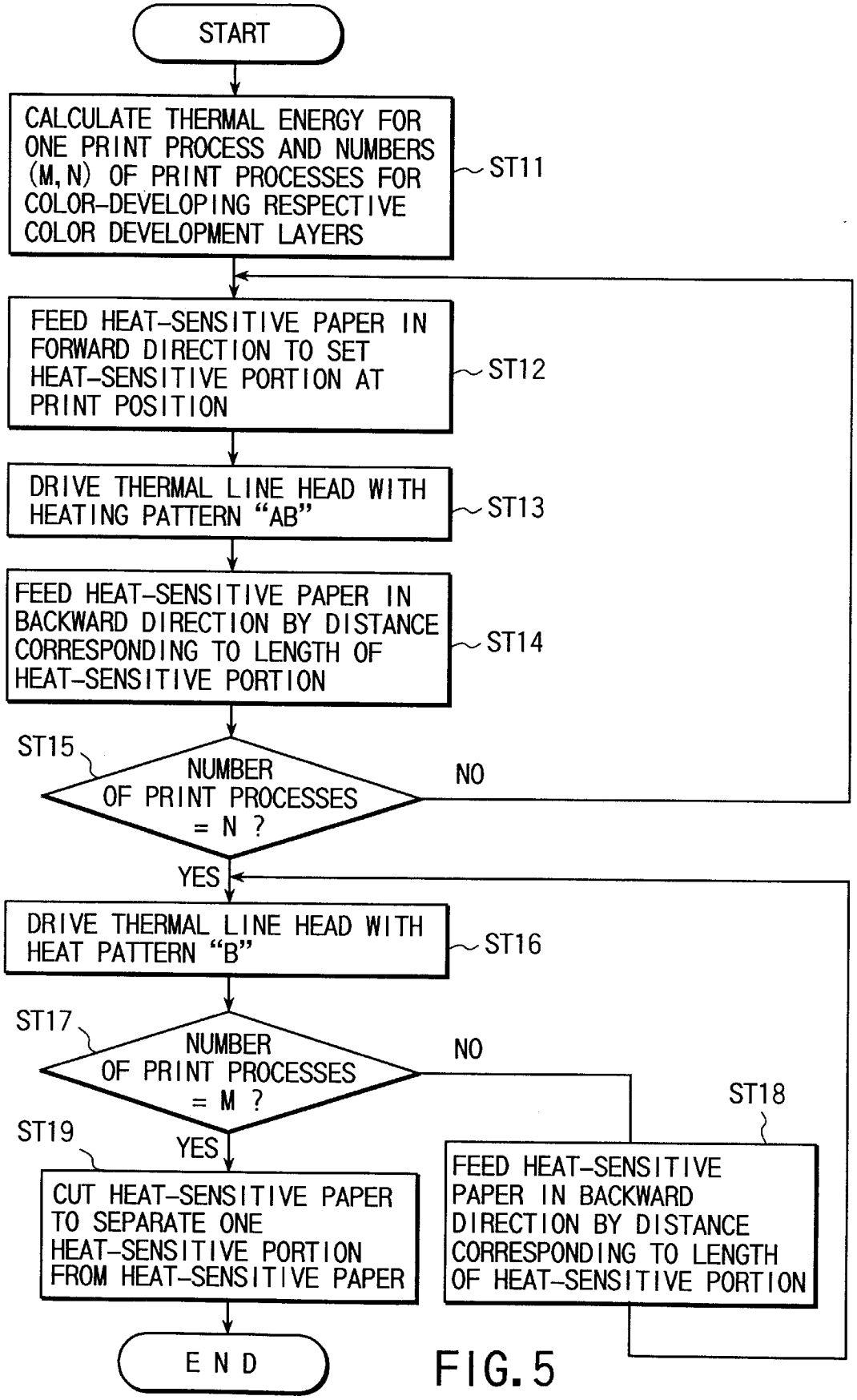
FIG. 5 is a flowchart showing a print control process of a CPU incorporated in a thermal printer according to a second embodiment of the present invention.

In the case where the above thermal printer prints a red character "A" and a black character "B" on the heat-sensitive paper 32, the CPU 1 thereof performs a print control process shown in FIG. 5 on the basis of the above principle. More specifically, in step ST11, the CPU 1 calculates the common measures of the thermal energies E1 and E2 and defines one of the common measures as the reference thermal energy E0 for each print process. The thermal energy E1 is divided by the reference thermal energy E0 to obtain the number M of print processes required for developing the color development layer 103. Similarly, the thermal energy E2 is divided by the reference thermal energy E0 to obtain the number N of print processes required for developing the color development layer 102.

In step ST12, the paper feed motor 7 is driven in the forward direction to advance the heat-sensitive paper 32 so that the heat-sensitive portion 32*b* is brought into a printing position corresponding to the thermal line head 9. This changes the state of the heat-sensitive paper 32 from the state shown in FIG. 6A to the state shown in FIG. 6B. In this case, for example, a paper sensor may detect the leading end of the heat-sensitive paper 32, and the paper may be fed from the detection position by a predetermined amount.

Figure 6A:
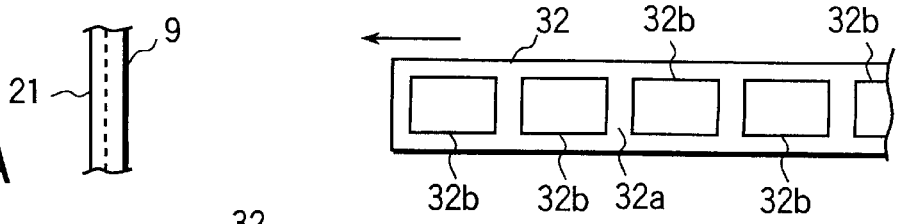
FIGS. 6A to 6H are views for explaining the operation of the thermal printer arranged as shown in FIG. 5.
Figure 6B:
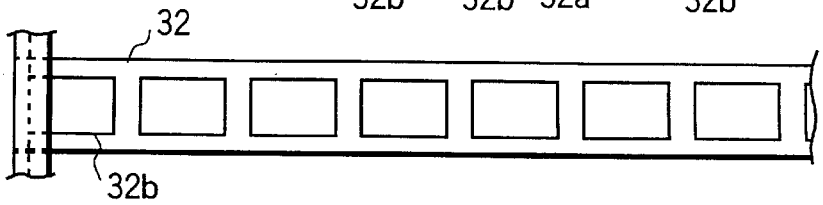
Figure 6C:
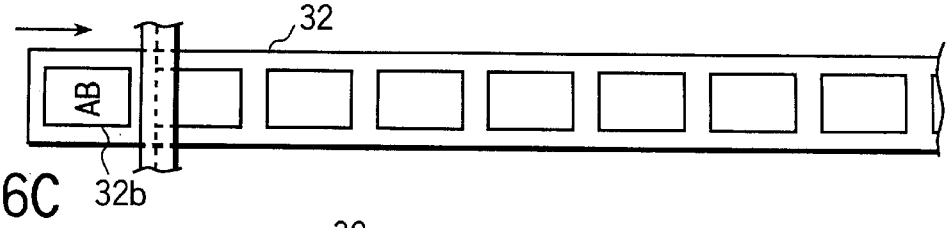
Figure 6D:
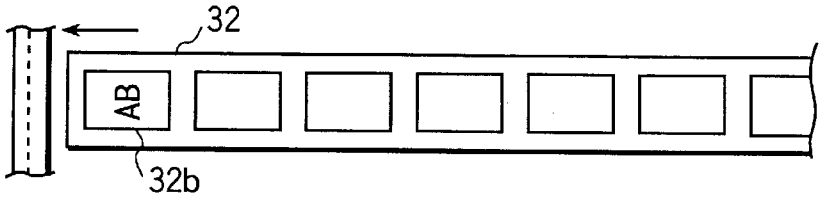
Figure 6E:
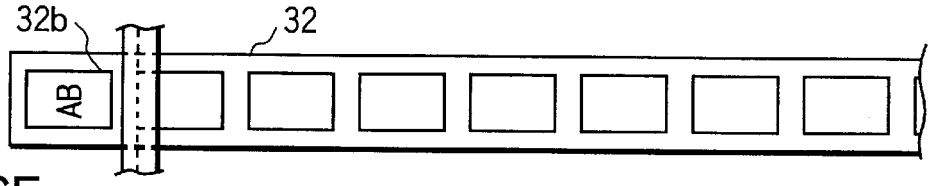
Figure 6F:
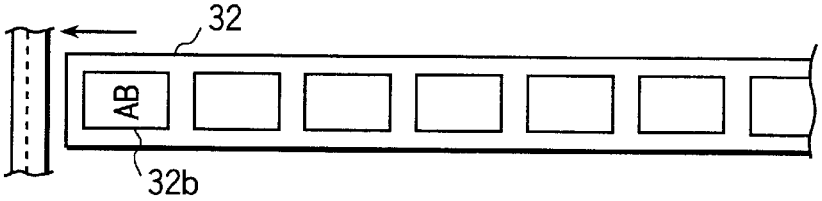
Figure 7A:
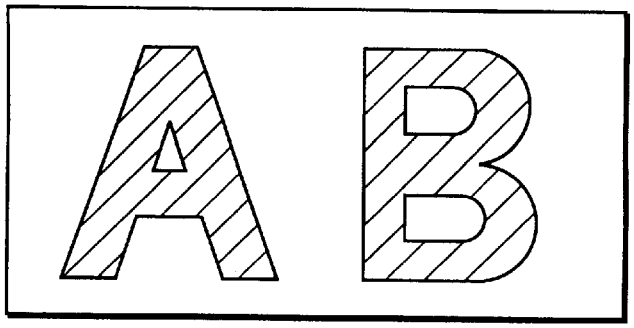
FIGS. 7A to 7D are views showing first, second, and third heating patterns of a thermal head incorporated in the thermal printer arranged as shown in FIG. 5, and the print pattern of heat-sensitive paper.
Figure 7B:
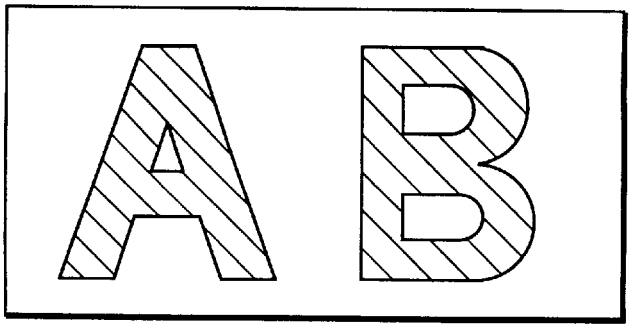

In step ST13, the thermal line head 9 is driven with a heating pattern "AB" shown in FIG. 7A to heat one heat-sensitive portion 32*b* with the reference thermal energy E0, until the heat-sensitive paper 32 is set to the state shown in FIG. 6C. Since the color development layers 103 and 102 are hardly developed by the reference thermal energy E0 applied once, a practical print pattern "AB" cannot be obtained in this print process. In step ST14, the paper feed motor 7 is driven in the reverse direction to return the head-sensitive paper 32 by a distance corresponding to the length of the printed heat-sensitive portion 32*b*. This changes the state of the heat-sensitive paper 32 from the state shown in FIG. 6C to the state shown in FIG. 6D.

It is then determined in step ST15 whether the number of print processes has reached N. If NO in step ST15, the flow returns to step ST12. The paper feed motor 7 is driven in the forward direction to advance the heat-sensitive paper 32 so that the heat-sensitive portion 32*b* is brought into the printing position corresponding to the thermal line head 9. In step ST13, the thermal line head 9 is driven again with the same heating pattern "AB" as that shown in FIG. 7A to heat one heat-sensitive portion 32*b* with the reference thermal energy E0, until the heat-sensitive paper 32 is set to the state shown in FIG. 6E. After printing is repeated twice as described above, the total amount of thermal energy applied to the heat-sensitive portion 32*b* according to the heating pattern "AB" reaches the thermal energy E1. Thus, a red print pattern "AB" can be obtained in the state shown in FIG. 6E. In step ST14, the paper feed motor 7 is driven in the reverse direction to return the head-sensitive paper 32 by a distance corresponding to the length of the printed heat-sensitive portion 32*b* , and then the heat-sensitive paper 32 is set to the state shown in FIG. 6F.

Figure 6G:
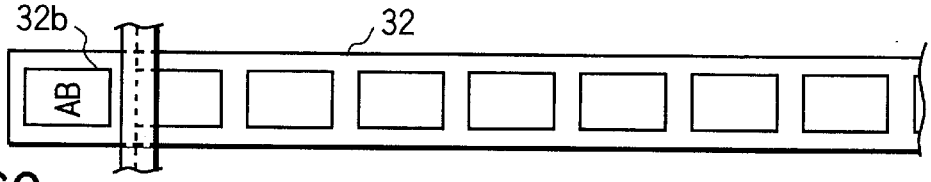
Figure 6H:
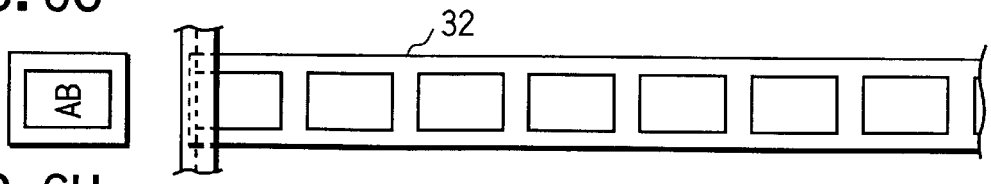
Figure 7C:
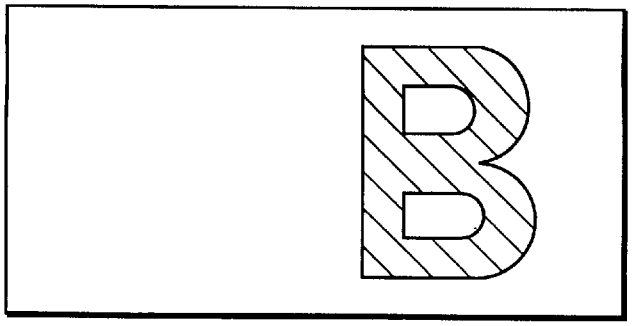
Figure 7D:
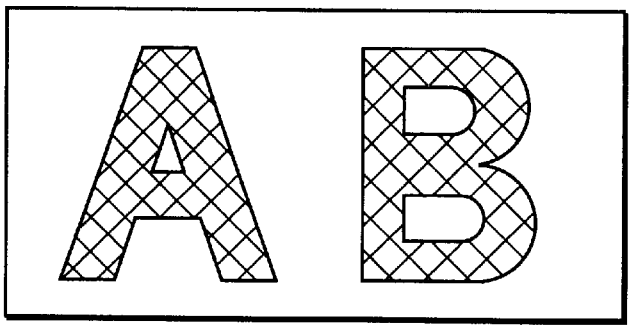

It is then determined in step ST15 whether the number of print processes has reached N. If YES in step ST15, the paper feed motor 7 is driven, in step ST16, in the forward direction again to advance the heat-sensitive paper 32 so that the heat-sensitive portion 32*b* is brought into the printing position corresponding to the thermal line head 9. Further, the thermal line head 9 is driven with a heating pattern "B" shown in FIG. 7C to heat the heat-sensitive portion 32*b* with the reference thermal energy E0 until the heat-sensitive paper 32 is set to the state shown in FIG. 6G. After printing is repeated three times as described above, the total amount of thermal energy which is applied to the heat-sensitive portion 32*b* according to the heating pattern "B" reaches the thermal energy level E2. As a result, the print pattern "B" is printed in black. That is, the print pattern "A" remains red as shown in FIG. 6G or 7D, while the print pattern "B" turns from red to black. Thereafter, in step ST19, the cutter motor 11 is then driven to cut the printed heat-sensitive portion 32*b* from the heat-sensitive paper 32 as shown in FIG. 6H. In addition, if the color development layer 102 is developed by a thermal energy which is an integer multiple of the reference thermal energy E0 and exceeds triple the reference thermal energy E0, the paper feed motor 7 is driven, in step ST16, in the reverse direction to return the head-sensitive paper 32 by a distance corresponding to the length of the printed heat-sensitive portion 32*b* , and then the flow returns to step ST16.

In the thermal printer of this embodiment, the common measures of the thermal energies E2 and E1 required for developing the color development layers 102 and 103 are calculated, and one of the common measures is defined as the reference thermal energy E0 to be applied for one print process. The numbers M and N of print processes required for developing the color development layers 102 and 103 are calculated by dividing the thermal energies E2 and E1 by the reference thermal energy E0 to be applied for one print process. The print process is repeated N times with the heating pattern "AB", and (M−N) times with the heating pattern "B". As a result, a red print pattern "A" is formed within a region heated N times, and a black print pattern "B" is formed within a region heated M times.

With the above arrangement, if the thermal energies required for developing the color development layers have an integer ratio, the thermal line head 9 can develop these color development layers in the manner described above. Since it is not necessary that the thermal energies required for developing the color development layers are fully applied from the thermal line head 9 in one print process, the durability of the thermal line head 9 can be improved, the service life of the head can be prolonged, and any degradation of the printing quality resulting from deterioration of the head can be prevented.

In the above embodiment, the common measures of the thermal energies required for developing the color development layers 102 and 103 are calculated, and one of the common measures is defined as the thermal energy to be applied for one print process. However, if the maximum common measure of the thermal energies required for developing the respective color development layers is calculated and defined as the thermal energy to be applied for one print process, the number of print processes required for developing each color development layer can be minimized, thereby reducing the total printing time.

Further, in the second embodiment, the heat-sensitive member 32 is used in place of the heat-sensitive paper 22 used in the first embodiment. However, this heat-sensitive paper 22 may be used in the second embodiment to obtain the same effect as described above.

A thermal printer according to the third embodiment of the present invention will be described below. This thermal printer is identical to that of FIG. 1 except for the structure described below. Therefore, similar components are denoted by the same reference numerals, and detailed description thereof will be omitted.

In the third embodiment, printing is performed on heat-sensitive paper obtained by stacking a first color development layer to be developed by the lowest thermal energy and color development layers to be developed by thermal energies which are integer multiples of the lowest thermal energy. More specifically, this heat-sensitive paper includes continuous base paper and heat-sensitive portions arranged in series on the base paper and spaced from each other by a constant distance. Each heat-sensitive portion is obtained by stacking a first color development layer having development characteristics represented by a characteristic curve y8 shown in FIG. 9, a second color development layer having development characteristics represented by a characteristic curve y7 shown in FIG. 9, a third color development layer having development characteristics represented by a characteristic curve y6 shown in FIG. 9, a fourth color development layer having development characteristics represented by a characteristic curve y5 shown in FIG. 9, and a coating layer for preventing a yellowish surface due to long-term storage, for example. The fourth, third, second, and first color development layers are sufficiently developed by thermal energies Em, 2Em, 3Em, 4Em which are integer multiples of the thermal energy Em and applied once.

In this case, the first to fourth color development layers can be developed by repeatedly applying the same thermal energy Em. That is, the fourth color development layer is developed in one print process, the third color development layer is developed in two print processes, the second color development layer is developed in three print processes, and the first color development layer is developed in four print processes. As described above, according to this embodiment, the total amount of thermal energy increases to an integer multiple of the thermal energy Em determined by the number of times of a print process to develop the color development layers in sequence.

As described in the first embodiment, in a case where the thermal printer performs printing on dual-color heat-sensitive paper having a stack of color development layers whose ratio of color development thermal energies is 1:2, a print process is repeatedly performed in steps ST2 and ST5 as shown in FIG. 2 with the same thermal energy Er. Particularly, in the third embodiment, printing is performed on heat-sensitive paper obtained by stacking a first color development layer to be developed by the lowest thermal energy Em and color development layers to be developed by thermal energies which are integer multiples of the lowest thermal energy Em. In this case, a desired color development layer can be developed by repeating a print process of applying a constant thermal energy such as the lowest thermal energy Em in view of the number of the color development layers. Therefore, as in the same manner as the first and second embodiments, the durability of the thermal line head 9 can be improved, and any degradation of the printing quality resulting from deterioration of the head can be prevented. In addition, since the total amount of thermal energy increases to an integer multiple of the thermal energy Em determined by the number of times of a print process to develop the color development layers in sequence, a complicated control is not required for developing these color development layers.

Figure 9:
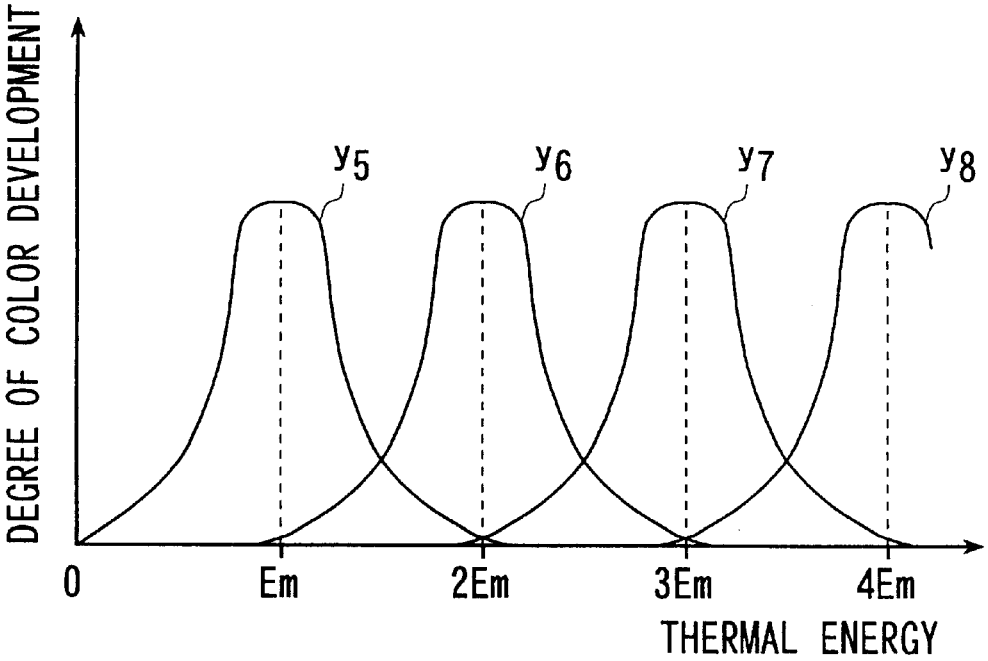
FIG. 9 is a graph showing the characteristics of heat-sensitive paper used in a thermal printer according to a third embodiment of the present invention.
Figure 10:
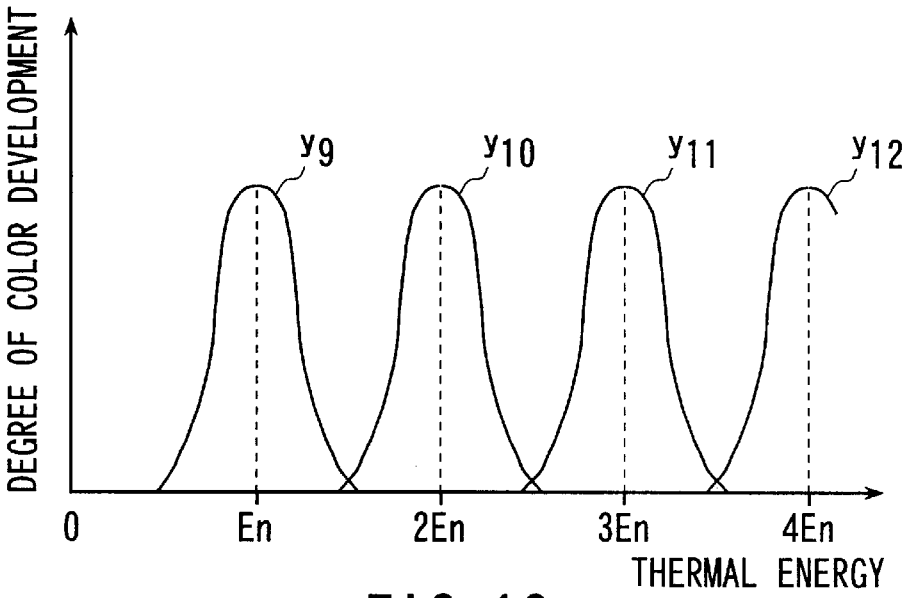
FIG. 10 is a graph showing the characteristics of heat-sensitive paper that may be used in place of heat-sensitive paper having the characteristics shown in FIG. 9.
Figure 11:
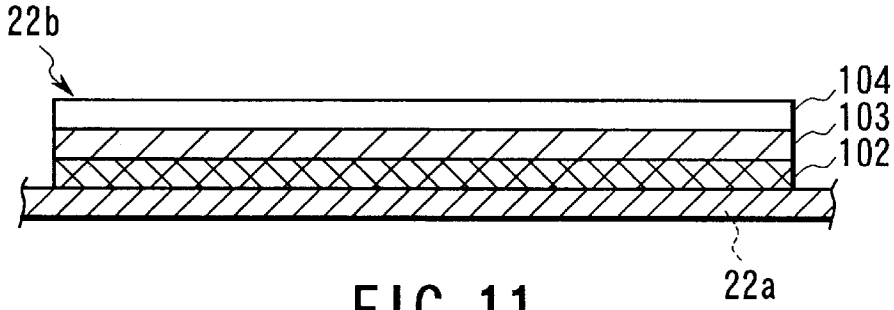
FIG. 11 is a sectional view showing the structure of general multicolor heat-sensitive paper.

With thermal printer of the third embodiment, the heat-sensitive paper having characteristics shown in FIG. 9 may be replaced by one having the characteristics shown in FIG. 10. This heat-sensitive paper of FIG. 10 includes continuous base paper and heat-sensitive portions arranged in series on the base paper and spaced from each other by a constant distance. Each heat-sensitive portion is obtained by stacking a first color development layer having development characteristics represented by a characteristic curve y12 shown in FIG. 10, a second color development layer having development characteristics represented by a characteristic curve y11 shown in FIG. 10, a third color development layer having development characteristics represented by a characteristic curve y10 shown in FIG. 10, a fourth color development layer having development characteristics represented by a characteristic curve y9 shown in FIG. 10, and a coating layer for preventing a yellowish surface due to long-term storage, for example. The fourth, third, second, and first color development layers are fully developed by thermal energies En, 2En, 3En, and 4En which are integer multiples of the thermal energy Em. An outstanding feature of FIG. 10 resides in that any remarkable overlap is not present between the characteristic curves y9, y10, y11, and y12.

It is preferable that the thermal line head 9 applies the thermal energies En, 2En, 3En, and 4En to develop the fourth, third, second, and first color development layers, respectively. However, an undesired color development layer may be developed if a remarkable overlap is present between the characteristic curves. In FIG. 9, a remarkable overlap is present between the characteristic curves y5 and y6 of the first and second color development layers, for example. In a case where the thermal energy Em is applied to the heat-sensitive paper to develop the first color development layer, the second color development layer is slightly developed by the thermal energy Em. Therefore, such heat-sensitive paper is not suitable for a purpose requiring strict differences in printed colors.

To the contrary, in the heat-sensitive paper having the characteristics shown in FIG. 10, the character curve y10 of the second color development layer does not remarkably overlap the characteristic curve y9 of the first color development layer, for example. Since no remarkable overlap is present, the second color development layer is not developed by the thermal energy En applied to develop the first color development layer. Such conclusion is obtained commonly for the thermal energies applied to develop the first to fourth color development layers.

When the heat-sensitive paper is one including a stack of color development layers whose characteristic curves do not remarkably overlap each other, a desired one of the color development layers can be developed while preventing development of the remaining color development layers for each print process. Therefore, this heat-sensitive paper can comply with a requirement of strict differences in printed colors.

As has been described above, according to the present invention, the durability of the thermal head can be improved without requiring a complicated control, the service life of the head can be prolonged, and any degradation of the printing quality resulting from deterioration of the head can be prevented.

When the multicolor heat-sensitive paper includes a stack of color development layers to be developed by the thermal energies applied as integer multiples of the lowest thermal energy required for developing one of the color development layers, the characteristic curves of the color development layers are determined not to overlap each other. Therefore, a desired one of the color development layers can be developed while preventing development of the remaining color development layers for each print process.

The present invention is not limited to the aforementioned embodiments. In the above embodiments, the initial print process is performed with a heating pattern for applying heat to a color development layer which is developed by the lowest thermal energy. However, this color development layer may be applied with heat in a subsequent print process instead of the initial print process. For example, the first embodiment may be modified such that the thermal line head 9 is driven with the heating pattern "B" in step ST2 and with the heating pattern "AB" in step ST5.

Further, the present invention is applicable to the discoloration type heat-sensitive paper in addition to the additive color type heat-sensitive paper.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A thermal printer comprising:

a paper feed mechanism for feeding heat-sensitive paper having a stack of color development layers which require different optimum thermal energies for development;

a thermal head for heating the heat-sensitive paper fed by said paper feed mechanism to print a multicolor image thereon; and a control unit for performing a print control process of repeatedly driving said thermal head to heat the heat-sensitive paper with heat patterns each having reference thermal energy not higher than the lowest of the optimum thermal energies to thereby selectively develop the color development layers according to total reference thermal energy accumulated in an area of the heat-sensitive paper selected by each heat pattern.

2. A thermal printer according to claim 1, wherein said color development layers have development characteristics that each of the optimum thermal energies does not fall within thermal energy ranges capable of developing the other color development layers.

3. A thermal printer according to claim 1, wherein said reference energy is kept constant.

4. A thermal printer according to claim 3, wherein said heat patterns are provided in numbers not greater than the stack of color development layers.

5. A thermal printer according to claim 3, wherein said reference thermal energy is equal to one of common divisors of the optimum thermal energies.

6. A thermal printer according to claim 3, wherein said reference thermal energy is equal to the greatest of common divisors of the optimum thermal energies.

7. A thermal printer according to claim 3, wherein said reference thermal energy is equal to the lowest of the optimum thermal energies.

* * * * *